United States Patent [19]

Uchida et al.

[11] Patent Number: 4,900,187

[45] Date of Patent: Feb. 13, 1990

[54] HYDRAULIC ACTUATOR AND LIFT APPARATUS

[75] Inventors: Jack Uchida; Christopher J. Michaelsen, both of Seattle, Wash.

[73] Assignee: Nyman Pile Driving, Inc., Issaquah, Wash.

[21] Appl. No.: 113,089

[22] Filed: Oct. 23, 1987

[51] Int. Cl.[4] ..... B63C 3/06

[52] U.S. Cl. ..... 405/3; 405/2; 114/48; 114/44

[58] Field of Search ..... 405/1–3; 114/44, 48, 51; 254/93 R, 228, 277; 92/137, 240, 255, 175; 414/678

[56] References Cited

U.S. PATENT DOCUMENTS

| | | | |
|---|---|---|---|
| 728,117 | 5/1903 | Kirsch et al. | 405/2 |
| 1,106,930 | 8/1914 | Desmond | 92/137 |
| 1,503,369 | 7/1924 | Lavoie | 92/175 |
| 2,598,271 | 5/1952 | Klosterman | 92/175 X |
| 2,613,915 | 10/1952 | Stone | 92/137 X |
| 3,033,626 | 5/1962 | Corley | 92/175 X |
| 3,062,601 | 11/1962 | Sadler et al. | 92/240 |
| 3,319,537 | 5/1967 | Pittman | 92/242 |
| 4,121,840 | 10/1978 | Berg | 92/137 X |
| 4,432,664 | 2/1984 | Baldyga | 405/3 |
| 4,641,996 | 2/1987 | Seal | 405/2 |
| 4,678,366 | 7/1987 | Williamson | 405/3 |

FOREIGN PATENT DOCUMENTS

| | | | |
|---|---|---|---|
| 1118581 | 10/1984 | U.S.S.R. | 405/3 |
| 5512 | 11/1883 | United Kingdom | 405/3 |

*Primary Examiner*—Randolph A. Reese
*Assistant Examiner*—John A. Ricci
*Attorney, Agent, or Firm*—Ward Brown; Robert W. Beach

[57] ABSTRACT

An elongated operating cylinder has an internal piston assembly including axially spaced diametral disks. Such assembly is movable lengthwise in the internal cavity of the cylinder. A flexible force-transmitting component is connected to the piston assembly and extends axially of the cylinder through one of its ends. Introduction of fluid under pressure into the cylinder cavity tends to move the piston assembly axially so as to apply a pulling force to the flexible force-transmitting component, adapting the cylinder for use as a fluid-pressure actuator. Such fluid pressure actuator is particularly suited for use in lift apparatus where a compact, stationary frame has upright rails along which a lift carriage is movable. The lifting force preferably is provided by the flexible force-transmitting component of the actuator which can be routed by one or more pulleys. The lift apparatus can be mounted adjacent to a dock for lifting a small watercraft from the water.

4 Claims, 3 Drawing Sheets

HYDRAULIC ACTUATOR AND LIFT APPARATUS

BACKGROUND OF THE INVENTION

1. Field of the Invention

The present invention relates to fluid pressure mechanism for applying a pulling force and to lift apparatus powered by such mechanism.

2. Prior Art

In a known simple jack, an operating cylinder has an internal piston moved lengthwise of the cylinder by introduction of fluid under pressure. A rigid plunger has an inner end connected to the piston and an outer free end portion extending axially through an end of the cylinder. Such a jack requires a large space for the range of motion to be achieved. In a representative installation, the space in which the jack is mounted must accommodate the entire length of the cylinder plus the desired range of motion of the plunger which, at most, would be approximately equal to the length of the cylinder. Consequently, the most compact installation must provide space for at least twice the desired length of linear motion of the plunger if the simple known fluid pressure jack is used.

With respect to another aspect of the present invention, there are known hydraulically powered lifts some of which have been adapted for underwater installation to raise and lower a large boat or a seaplane, for example. There is no known inexpensive compact lift specially adapted to be mounted on or adjacent to a dock for conveniently raising and lowering a small watercraft such as a skiff, rowboat, canoe or jet ski.

SUMMARY OF THE INVENTION

The present invention provides an improved fluid pressure actuator of the type using an elongated operating cylinder and an internal piston. A flexible force-transmitting component is connected to the piston and extends axially through a leakproof but sliding fitting at one end of the cylinder. Preferably, such flexible component is a cable sheathed in smooth slippery plastic. Such cable replaces the rigid plunger of a conventional fluid pressure cylinder actuator and is effective for applying pulling but not pushing force by introduction of fluid under pressure into the cylinder at the side of the piston to which the cable is connected. The piston preferably has two axially spaced disks, ne of which is designed to prevent fluid under pressure from leaking past the piston, and the other of which is provided primarily to guide the composite piston assembly for axial movement without racking or canting relative to the cylinder.

In the preferred installation, the actuator in accordance with the present invention provides the force for raising a lift platform which is guided for vertical movement along upright stationary rails. The rails are part of a stationary frame connected to a dock and the lift platform is adapted for raising and lowering a small watercraft. The actuator with its flexible force-transmitting component allows a particularly compact overall construction. By using water as the fluid introduced under pressure into the actuator, a very simple and inexpensive operation is assured without possibility of undesirable contamination by leaks and without requiring special apparatus for pumping or storing other operating liquids or gases.

DETAILED DESCRIPTION

Figure 1:
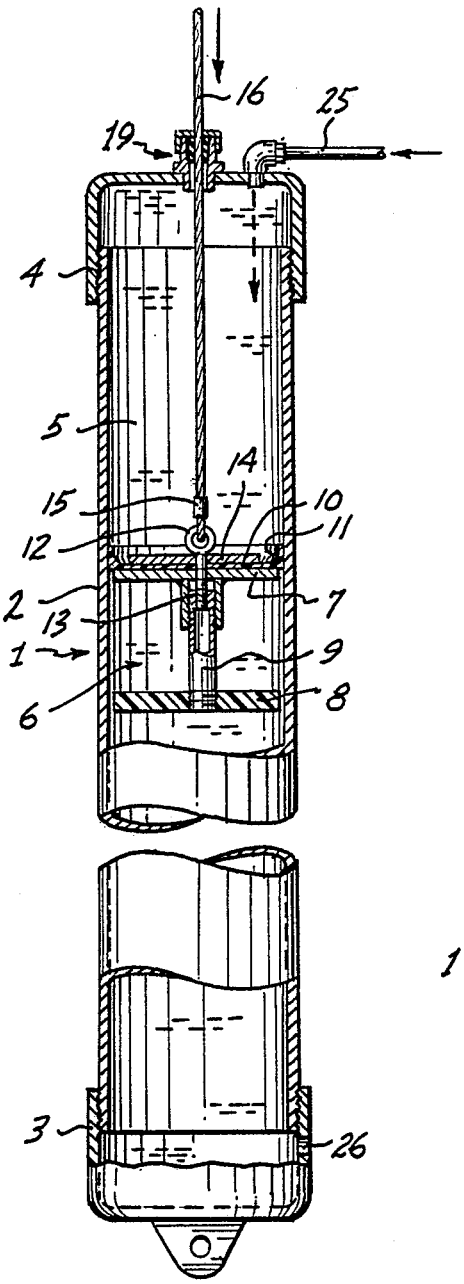
FIG. 1 is a somewhat diagrammatic side elevation of a hydraulic actuator in accordance with the present invention with parts broken away such that the internal components of such actuator are seen primarily in axial section.

As seen in FIG. 1, the preferred hydraulic actuator 1 in accordance with the present invention has an elongated cylinder 2 with a bottom end cap 3 and a top end cap 4 substantially closing the cylinder interior pressure cavity 5. Mounted in such cavity is a piston assembly 6 including axially spaced diametral disks 7 and 8 connected by an elongated central stud 9.

Disks 7 and 8 fit closely in the cylinder cavity but not so closely as to interfere appreciably with longitudinal sliding movement of the piston assembly. Disk 7, the top disk as viewed in FIG. 1, carries a flexible gasket or cup 10 including an upturned lip portion 11 to prevent operating liquid from leaking past the piston assembly. Operating liquid introduced into the upper portion of the cylinder cavity tends to press the cup lip 11 outward against the smooth inner wall of the cylinder 2. The bottom disk, disk 8, is spaced a substantial distance below the top disk by the stud 9, preferably at least several times the axial extent of either disk, to guide longitudinal movement of the assembly while preventing racking or canting relative to the cylinder.

An integral portion of the piston assembly 6 is an eye bolt 12 having a shank 13 screwed into the central stud 9 and clamping the flexible piston cup 10 against the top piston disk 8 by engagement against a central washer 14. The diameter of washer 14 is only slightly less than the diameter of disk 7 so that substantially the entire central portion of the flexible cup 10 is rigidified by being clamped between the rigid washer and disk.

Figure 2:
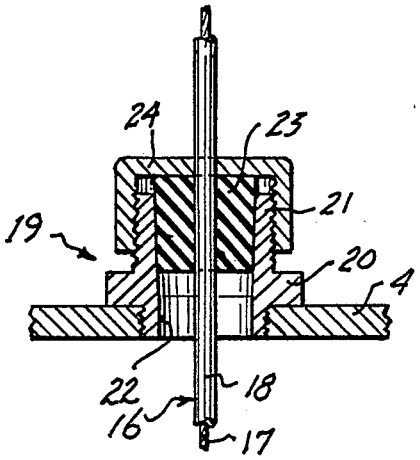
FIG. 2 is a fragmentary, enlarged, axial section of an end portion of such actuator.

The eye of bolt 12 serves as the connection point for one end portion 15 of an elongated, flexible, force-transmitting component 16 extending lengthwise axially of the cylinder 2 away from the piston assembly 6. As seen in FIG. 2, preferably the flexible component 16 includes a core cable 17 and an outer smooth plastic sheath 18. FIG. 2 also illustrates in greater detail the top fitting 19 through which the sheathed cable 16 extends. Such fitting 19 includes a plastic nipple 20 screwed tightly into the horizontal portion of the cylinder cap 4 and an upper externally threaded neck 21. The bore 22 of the nipple 20 is tapered downward and receives a correspondingly tapered resilient plug member 23 having a central bore for the sheathed cable 16. A screw cap 24 has a central bore registered with the bore of plug member 23. When screwed onto the nipple neck portion 21, cap 24 forces the plug member progressively downward in the tapered bore 22 such that a substantially leakproof but sliding fit of the sheathed cable 16 in the plug member 23 is assured. The fitting 19 is of the type known to have been used in some marine applications such as where steering or control cables extend through a panel or bulkhead of a boat.

Returning to FIG. 1, fluid under pressure, preferably water, is introduced through the top of the cylinder cap 4 by way of an inlet conduit 25 to force the piston assembly 6 downward, thereby applying pulling force and imparting axial motion to the flexible force-transmitting component 16. The range of travel of the piston assembly and, hence, the force-transmitting component 16 is limited only by the length of the cylinder. An outlet or vent opening 26 is provided adjacent to the bottom of the cylinder 2 so that movement of the piston assembly is not resisted. A reservoir or accumulator can be connected to the vent opening 26 if desired but is not required in the preferred application described below.

Force can be applied by the actuator 1 only in one direction by movement of the piston assembly 6 inside the cylinder 2, i.e., pulling force by the flexible component or cable 16. Nevertheless, a significant advantage is that simple mechanical components such as pulleys can be used to route the cable sideways or even back downward at a location close to the end cap 4 of the cylinder, permitting a particularly compact construction, such as in the lift apparatus shown in FIGS. 3 and 4. In such apparatus, the actuator 1 is mounted in upright position on a stationary frame which includes upright legs or rails 30 of U cross section, such rails 30 being spaced apart and having their grooves or ways facing each other. The top ends of the rails 30 are joined by an angle cross member having a horizontal flange 31 connected along a top margin of a conventional dock D. As seen in FIG. 4, such dock can have a supporting vertical piling P carrying cross support beams B and joists including an edge joist J and central joist J' for the top deck or flooring F. As best seen in FIG. 4, all frame components are flush with or below the top surface of the dock.

Figure 3:
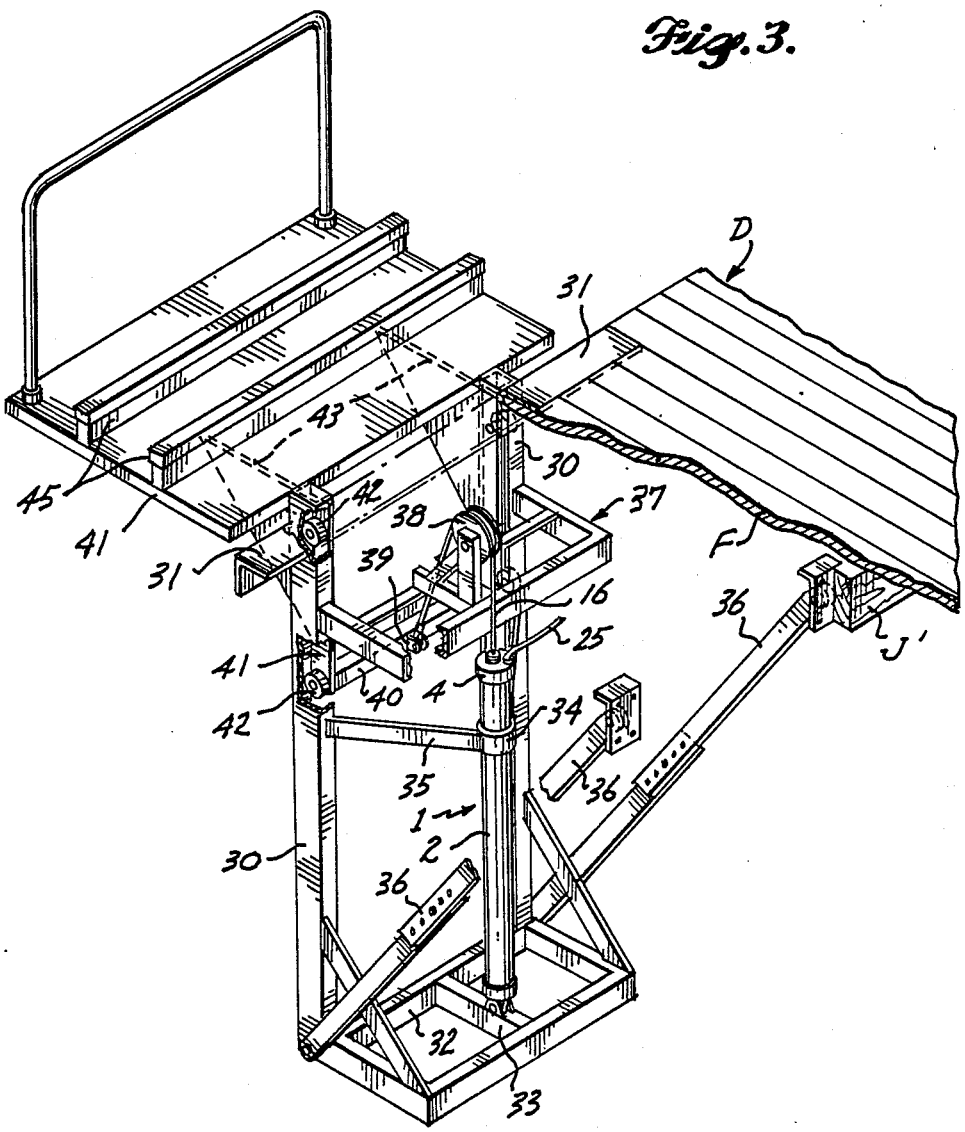
FIG. 3 is a top perspective of hydraulic lift apparatus in accordance with the present invention utilizing the actuator of FIGS. 1 and 2, with parts broken away.
Figure 4:
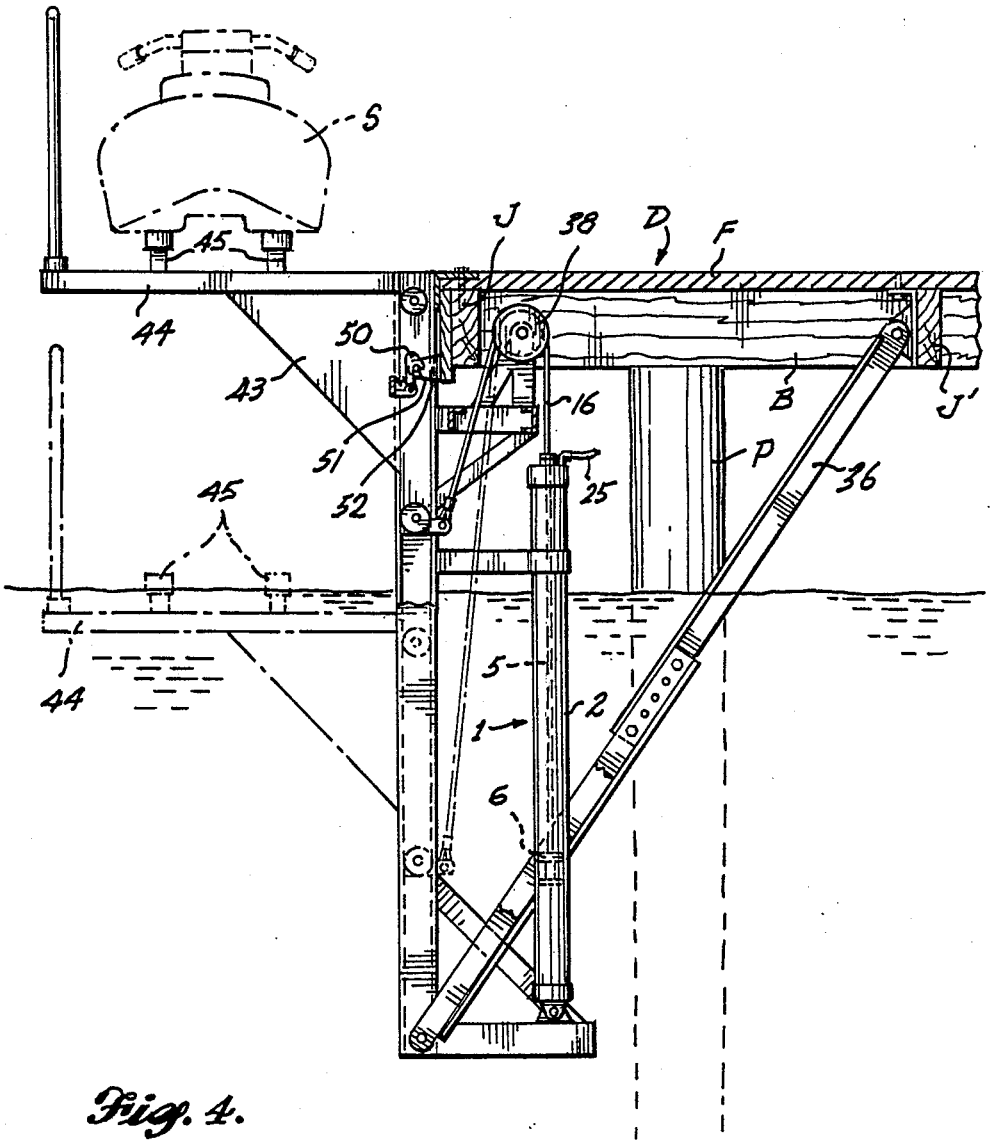
FIG. 4 is a somewhat diagrammatic side elevation of such lift apparatus, with some parts broken away, illustrating the lift apparatus as mounted on a conventional dock.

With reference to FIG. 3, the bottom end portions of the rails 30 are supported by upward and inward extending braces 36 which can have their top end portions secured to the central joist J' and flooring F of the dock.

The bottom end portions of rails 30 also are joined by a bottom cross member 32 forming one side of a rectangular bottom frame which has a central horizontal member 33 to which the bottom end portion of the actuator 1 is connected. The actuator cylinder 2 is supported intermediate its ends by a collar 34 carried by angular support bars 35 extending inward from the spaced rails 30.

The stationary components of the lift apparatus are completed by a top stationary frame 37 mounted on the upright rails 30 and carrying a central pulley 38 underneath the dock flooring F for rotation about a horizontal transverse axis. The inner edge portion of the pulley is aligned axially with the actuator cylinder 2 for receiving the elongated, flexible, force-transmitting component (sheathed cable) 16 which extends up and over the pulley and then downward to its outer end portion 39. Such outer end portion 39 of the cable 16 is connected to the bottom horizontal cross member 40 of a lift carriage which has opposite upright side plates 41 carrying rollers 42 for movement in the grooves or ways of the U cross section rails 30. Such plates 41 carry triangular gusset-like supports 43 for the lift frame or platform 44 which can have elongated pads 45 for the small watercraft to be lifted. As seen in FIG. 4, such craft can be a jet ski S, for example.

With reference to FIG. 4, in operation the vertically moving carriage and its lift platform 44 initially are in the broken line position with the support pads 45 at about the water level. In such position, the internal piston assembly 6 of the actuator 1 will be close to the top of the cylinder 2. Introduction of fluid, preferably water, through the inlet conduit 25 applies force to the piston assembly 6 moving it downward to the position shown in FIG. 4 which raises the carriage and its lifting platform 44 to the solid line position. It will be noted that the maximum range of movement of the lifting platform is about equal to or slightly less than the overall length of the actuator cylinder 2, but the cylinder can be mounted upright much closer to the guide pulley 38 to impart the vertical motion to the lift platform and carriage. By comparison, if a known fluid pressure jack with a rigid plunger were used, the compact mounting would not be possible or complicated movement-exaggerating mechanical components would have to be used.

Preferably, the lifting platform and carriage are locked automatically in the raised position such as by the latch hook 50 pivoted on one of the carriage sideplates 41 and automatically hooked over a pin 51 mounted on a bracket 52 extending from the adjacent dock edge. Consequently, the carriage is retained in the raised position even if fluid pressure in the top cylinder cavity 5 is relieved. In such raised position the top supporting surface of the lifting platform is at least as high as the top surface of the dock. Since the side of the lifting platform adjacent to the dock is open and unobstructed, the watercraft can be conveniently loaded onto or off the platform. When it is desired to lower the lift platform, the platform must be raised by operation of the actuator 1 before the latch hook 50 can be moved manually away from its pin, whereupon the lift platform and carriage is lowered by gravity as water is forced outward through the small conduit 25.

The frame and lift carriage components can be constructed of corrosion-resistant metals, whereas the actuator can be constructed of readily available plastic materials such as PVC plastic. Preferably, the actuator and lift are engineered so that standard water pressure such as from a garden hose is sufficient to raise and lower the lift carriage and the desired watercraft with no supplemental fluid pressure pumps being required. Also, the use of water in the underwater installation eliminates any necessity for a completely fluid-tight closed piping system with accumulators and reservoirs, for example. Small leaks may slightly lessen the lifting effectiveness, but have no contamination effect nor do they require immediate maintenance to maintain operability of the system.

Figure 5:
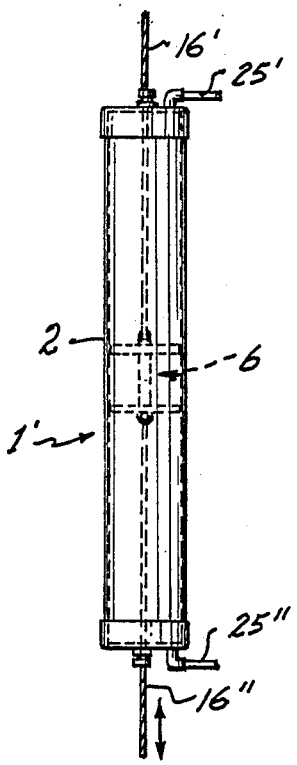
FIG. 5 (on the drawing sheet with FIGS. 1 and 2) is a somewhat diagrammatic side elevation of a modified hydraulic actuator in accordance with the present invention.

In the lift apparatus shown in FIGS. 3 and 4, the platform 44 is lowered by gravity. In other applications it may be required to provide positive force in opposite directions, in which case the modified actuator 1' shown in FIG. 5 can be used. Such actuator has the operating cylinder 2 and internal piston assembly 6 substantially indentical to the cylinder and piston assembly of the previously described embodiment, but with opposite stretches 16' and 16'' of cable extending axially from the piston assembly and through the opposite ends of the cylinder. Fluid under pressure can be introduced through conduit 25' in one end or conduit 25'' in the other end to move the piston assembly and cable in the desired direction. Pulleys can route the cable stretches 16′ and 16″ to the member or members to be moved.

We claim:

1. Apparatus for lifting a small watercraft from the water adjacent to a dock having a top horizontal surface above the surface of the water, said apparatus comprising a frame mounted stationarily relative to the dock, said frame including at least one stationary upright rail disposed adjacent to the dock, a lift carriage movable along said rail and including a lifting platform for raising and lowering the watercraft and supporting structure below said lifting platform, said lifting platform having a top horizontal watercraft-supporting surface and opposite sides adjacent to and remote from said dock, respectively, said lifting platform being movable between a lowered position below the surface of the water and a raised position in which its top surface is disposed above the surface of the water at a level at least as high as the top surface of the dock, said side of said lifting platform adjacent to said dock being open and unobstructed and said stationary rail extending no higher than said top surface of said lifting platform in its raised position, a hydraulic actuator having an upright operating cylinder with an elongated internal cavity of a length at least equal to the range of movement of said lift carriage along said rail, a piston assembly closely fitted inside said cavity of said operating cylinder and movable axially thereof and a flexible force-transmitting component connected to said piston assembly and extending generally axially of the cylinder through an end portion thereof, said hydraulic actuator being mounted on said frame and disposed entirely below said top surface of said lifting platform in its raised position, a pulley mounted on said frame at a location closer to said cylinder than the distance of the maximum motion of said lift carriage for rotation about a horizontal axis and having a portion registered axially with said cylinder, said pulley being disposed adjacent to said rail and entirely below said top surface of said lifting platform in its raised position, said flexible force-transmitting component extending around said pulley and having an outer end portion located opposite said pulley from said cylinder connected to said supporting structure below said lifting platform of said lift carriage, and means for introducing fluid under pressure into said cylinder so as to move said piston assembly in a direction to apply force to said lifting carriage through said force-transmitting component and move said lifting platform to its raised position for loading and unloading of the small watercraft between the dock and said lifting platform without obstruction.

2. Apparatus for lifting a small watercraft adjacent to a dock comprising a frame mounted stationarily relative to the dock, said frame including at least one stationary upright rail, a lift carriage movable along said rail and including a lifting platform for raising and lowering the watercraft, a hydraulic actuator having an upright operating cylinder with an elongated internal cavity, a piston assembly closely fitted inside said cavity of said operating cylinder and movable axially thereof and a flexible force-transmitting component connected to said piston assembly and extending generally axially of the cylinder through an end portion thereof, a pulley mounted on said frame for rotation about a horizontal axis and having a portion registered axially with said cylinder, said flexible force transmitting component extending around said pulley and having an outer end portion located opposite said pulley from said cylinder connected to said lift carriage, means for introducing fluid under pressure into said cylinder so as to move said piston assembly in a direction to apply force to said lifting carriage through said force-transmitting component, said piston assembly including two diametral disks each closely fitted in said cavity of said cylinder and a central stud connecting said disks and spacing them apart axially of said cylinder cavity a distance at least several times greater than the axial extend of either of said disks, a flexible cup having an upturned outer peripheral portion extending from one of such diametral disks in the same direction as the direction in which the flexible force-transmitting component extends from said piston assembly, a bolt member having a threaded shank screwed into said piston assembly, and means engaged by said bolt member for clamping said flexible cup to the adjacent diametral disk, the flexible force-transmitting component having an end portion connected to said bolt member.

3. In a hydraulic actuator having an operating cylinder with an elongated internal cavity, a piston assembly closely fitted inside such cavity of such operating cylinder and movable axially thereof and a flexible force-transmitting component connected to such piston assembly and extending generally axially of such cylinder through an end portion thereof, the improvement comprising the piston assembly including two diametral disks each closely fitted in such cavity of such cylinder and a central stud connecting said disks and spacing them apart axially of such cylinder cavity a distance at least several times greater than the axial extend of either of said disks, a flexible cup having an upturned outer peripheral portion extending from of said diametral disks in the same direction as the direction in which the flexible force-transmitting component extends from said piston assembly, a bolt member having a threaded shank screwed into said piston assembly, and means engaged by said bolt member for clamping said flexible cup to the adjacent diametral disk, the flexible force-transmitting component having an end portion connected to said bolt member.

4. Apparatus for lifting a small watercraft from the water adjacent to a dock having a top horizontal surface above the surface of the water, said apparatus comprising a frame mounted stationarily relative to the dock, said frame including at least one stationary upright rail disposed adjacent to the dock, a lift carriage movable along said rail and including a lifting platform for raising and lowering the watercraft and supporting structure below said lifting platform, said lifting platform having a top horizontal watercraft-supporting surface and opposite sides adjacent to and remote from said dock, respectively, said lifting platform being movable between a lowered position below the surface of the water and a raised position in which its top surface is disposed above the surface of the water at a level at least as high as the top surface of the dock, said side of said lifting platform adjacent to said dock being open and unobstructed and said stationary rail extending no higher than said top surface of said lifting platform in its raised position, and actuator means disposed entirely below said top surface of said lifting platform in its raised position and having a portion connected to said supporting structure below said lifting platform of said lift carriage for moving said lifting platform between its lowered and raised positions for loading and unloading of the small watercraft between the dock and said lifting platform without obstruction.

* * * * *